US005794538A

United States Patent [19]

Pitchford

[11] Patent Number: 5,794,538

[45] Date of Patent: Aug. 18, 1998

[54] RAILCAR TRUCK BEARING ADAPTER CONSTRUCTION

[75] Inventor: Terry L. Pitchford, St. Louis, Mo.

[73] Assignee: Amsted Industries Incorporated, Chicago, Ill.

[21] Appl. No.: 831,733

[22] Filed: Apr. 1, 1997

[51] Int. Cl.[6] ..... B61F 5/26

[52] U.S. Cl. ..... 105/218.1; 105/220; 105/224.1

[58] Field of Search ..... 105/218.2, 220, 105/221.1, 224.1

[56] References Cited

U.S. PATENT DOCUMENTS

| | | | |
|---|---|---|---|
| 3,211,112 | 10/1965 | Baker | 105/224.1 |
| 3,274,955 | 9/1966 | Thomas | 105/224.1 |
| 3,276,395 | 10/1996 | Heintzel | 105/224.1 |
| 3,381,629 | 5/1968 | Jones | 105/218 |
| 3,621,792 | 11/1971 | Lich | 105/224.1 |
| 3,699,897 | 10/1972 | Sherrick . | |
| 4,030,424 | 6/1977 | Garner et al. . | |
| 4,034,681 | 7/1977 | Neaumann et al. | 105/225 |
| 4,072,112 | 2/1978 | Wiebe . | |
| 4,078,501 | 3/1978 | Neaumann et al. | 105/225 |
| 4,082,043 | 4/1978 | Hammonds et al. . | |
| 4,103,623 | 8/1978 | Radwill . | |
| 4,103,624 | 8/1978 | Hammonds et al. . | |
| 4,108,080 | 8/1978 | Garner et al. . | |
| 4,192,240 | 3/1980 | Korpics | 105/225 |
| 4,242,966 | 1/1981 | Holt et al. . | |
| 4,416,203 | 11/1983 | Sherrick | 105/224.1 |
| 4,428,303 | 1/1984 | Tack | 105/225 |
| 4,841,875 | 6/1989 | Corsten et al. | 105/224.05 |

OTHER PUBLICATIONS

ASME Paper "Truck Hunting in the Three–Piece Freight Car Truck" by V. T. Hawthorne.

*Primary Examiner*—S. Joseph Morano
*Attorney, Agent, or Firm*—Edward J. Brosius; F. S. Gregorczyk; Stephen J. Manich

[57] ABSTRACT

A railcar truck, bearing-adapter assembly for an axle end has vertically extending arms to securely capture and maintain a roller bearing and axle end assembly at about an as-assembled reference position within the adapter assembly and sideframe pedestal jaw, where the as-assembled reference position has the railcar truck side frames about parallel and the axles about normal to the side frames, and which adapter assemblies in the opposed sideframe pedestal jaw are secured within a cross-passage at the ends of the truck side frames to capture and retain the axle ends in opposing side-frame pedestal jaws at about the reference as-assembled position to inhibit both horizontal and vertical axle displacement truck and thus minimize railcar truck warping.

20 Claims, 9 Drawing Sheets

RAILCAR TRUCK BEARING ADAPTER CONSTRUCTION

BACKGROUND OF THE INVENTION

1. Field of the Invention

The present invention relates to a bearing adapter assembly for a railcar truck. A railcar truck typically has a pair of parallel sideframes transversely coupled by a bolster at about the sideframe longitudinal midpoints. A pair of axles, which are generally parallel to the bolster and each other, join the respective forward and rearward opposed ends of the sideframes. The sideframe longitudinal axes are likewise approximately parallel and define a generally horizontal plane at a reference or as-assembled condition of the truck. The axles usually include journal bearings and bearing adapters on the axle ends, which adapters are nested and secured in the pedestal jaws at the sideframe ends.

Within this truck environment, the present invention more particularly provides tightly secured bearing adapters to firmly hold the axle bearing in position at each pedestal jaw to avoid displacement relative to the longitudinal direction of the sideframe, which displacement or variation can result in truck "warping". Past research has illustrated railcar truck warping induces truck hunting during railcar travel, which truck warping causes undue wear on rails and wheels, as well as increasing fuel usage. In extreme cases, warping or high-speed hunting may potentially be an unsafe operational condition leading to railcar derailment. Truck warping also has a detrimental effect on truck steering or ability of the railcar to negotiate a curve.

2. Description of the Prior Art

In a three-piece railcar truck assembly, the sideframes and bolster are generally aligned and square. That is, the side frames are parallel to each other but normal to the axles and bolster of the assembly, and, the axles and bolster are approximately parallel to each other. At certain railcar speeds, the truck may become dynamically unstable, which may loosely be defined as truck hunting. In "Car and Locomotive Cyclopedia" (1974), truck hunting is defined as "an instability at high speed of a wheel set (truck), causing it to weave down the track, usually with the (wheel) flanges striking the rail." As a consequence, review and analysis of truck hunting has been the subject of many past and ongoing research efforts within the rail industry by truck suppliers, car builders and railroad lines, as this is an undesirable condition for economic, operational and safety considerations. These past research efforts have noted a significant relationship between truck warping and resultant truck hunting. Some of these research efforts and past conclusions are discussed in the ASME paper, "Truck Hunting in the Three-Piece Freight Car Truck" by V. T. Hawthorne, which paper included historical reference to earlier research in this field. One of these earlier researchers noted ". . . that in the empty car the higher column force of the constant column damping provides a greater warp stiffness and, consequently, yields a higher critical (truck) hunting speed." The project for this cited ASME paper was designed to measure the following parameters: warp stiffness; lateral damping force; and, lateral spring rate.

In the above-noted Hawthorne project, the warp stiffness results duplicated earlier test results, which confirmed the appreciable decrease in warp stiffness as the warp angle increased to 1°(60 minutes) of angular displacement. Further, earlier warp stiffness data showed that a displacement of 1° in the warp angle represented the maximum warp travel of a relatively new truck during truck hunting.

Therefore, at warp angles prevalent in truck hunting, the warp stiffness fell considerably below the values necessary to raise the critical speed of hunting above the normal operating range of the freight railcar.

An application of the test results illustrated a new railcar truck running at a speed above 60 miles per hour with track inputs causing warp angles less than 0.3° would not be expected to hunt. However, if the warp angle suddenly increased to 1.0° due to a track irregularity, it is expected that the critical truck hunting speed of the railcar would drop to about 52 miles per hour and intermittent truck hunting would occur.

A three-piece railcar truck generally allows a considerable amount of relative movement between the wheel-axle assembly and the supporting side frame at the side-frame pedestal jaw. This movement may be due to the form of the connection between the journal end of the wheel and axle, as well as to machining or assembly tolerances permitted in the various components, such as manufacturing dimensional tolerances for the side-frame pedestal jaw, bearing adapter, and the axle. U.S. Pat. No. 3,211,112 to Baker discloses an assembly to damp the relative lateral movement between the wheel and axle assembly, and the associated side frame. More specifically, a resilient means or member is provided between the top of the journal end of the wheel and axle assembly, and the associated side frame member to produce varying frictional forces for damping the relative movement between the assembly and the side frame. The Baker-'112 patent recognized the undesirability of transmitting track perturbations through the axle, sideframes and bolsters, but inhibition of this force transmission was to be accomplished by damping the disturbances caused by lateral axle movements, not by suppressing their initiation.

In U.S. Pat. No. 3,274,955 to Thomas and also in U.S. Pat. No. 3,276,395 to Heintzel, a roller bearing adapter is illustrated with an elastomer on the upper part of the cap plate, which adapter is positioned in the side frame pedestal jaw with the elastomer between the pedestal jaw roof and the adapter for relieving exposure to high stresses. A similar concept is shown in U.S. Pat. No. 3,381,629 to Jones, which provided an elastomeric material between each bearing assembly and the pedestal roof to accommodate axial movements of the bearing assemblies of each axle and to alleviate lateral impact to the side frame.

Other assemblies and concepts have been utilized for maintaining a truck in a square or parallel relationship. In U.S. Pat. No. 4,103,623 to Radwill, friction shoes are provided to frictionally engage both the side frame column and bolster. This friction shoe arrangement is intended to increase the restraining moment, which is expected to result in an increased truck hunting speed. The friction shoes had contact surfaces with appropriate manufacturing tolerances to control initial contact areas for developing a maximum restraining moment.

U.S. Pat. No. 4,192,240 to Korpics provided a wear liner on the roof of a sideframe pedestal jaw. The disclosure recognized the detrimental effects of having a loose wear liner in the pedestal jaw. Wear liners are provided against the roof of the pedestal jaw to reduce wear in the roof caused by oscillating motions of the side frame relative to the wheel-axle assembly and the bearing. The disclosed wear liner included upwardly projecting tabs to grip the roof and sideframe to inhibit longitudinal movement of the wear liner, and downwardly projecting legs to cooperate with pedestal-jaw stop lugs to inhibit lateral movement of the wear liner relative to the roof. The stop lugs of the pedestal jaw are positioned on opposite sides of the depending legs of the jaw, which lugs are engageable with the downwardly depending wear liner legs.

U.S. Pat. No. 3,621,792 to Lich provides a pedestal jaw opening with outwardly sloped sidewalls and a bearing adapter with sloped sidewalls positioned in the jaw opening. An elastomeric component is positioned between the adapter and both of the pedestal sidewall and roof, which elastomer provides resistance in compression and yieldability in shear, as well as sufficient softness for cushioning. By positioning the elastomeric pad between all the interfaces of the adapter and the pedestal jaw, metal-to-metal contact is prevented along with wear and transmission of noise and vibration from the track to the truck framing. Similarly in U.S. Pat. Nos. 3,699,897 and 4,416,203 to Sherrick, a resilient pad is provided between the bearing adapter and the side frame.

U.S. Pat. No. 4,072,112 to Wiebe has an elastomeric positioning means placed intermediate the bearing carrier and one of the pedestal jaws to bias the bearing carrier into direct communication or engagement with the opposite pedestal jaw, which limits relative angular movement and linear displacement of the wheel set to the side frame.

U.S. Pat. Nos. 4,108,080 and 4,030,424 to Garner et al. teach a rigid H-frame truck assembly having resilient journal pads in the pedestal jaws. The truck provided by these developments demonstrated improved riding characteristics. Similarly U.S. Pat. Nos. 4,082,043 and 4,103,624 to Hammonds et al. disclosed an integral H-frame truck with resilient elements in the journal bearings.

In U.S. Pat. No. 4,242,966 to Holt et al., a railcar truck has a transom with a pair of tubes rigidly connected between the longitudinally extending side frames. The transom allows vertical movement of the side frames but resists longitudinal displacement of the side frames with respect to each other.

A suspension arrangement with at least two annular elastomeric shock absorbers having an optimum adjustability in the longitudinal and transverse directions of the vehicle is provided in U.S. Pat. No. 4,841,875 to Corsten et al.

Alternative means for the insertion and securing of a wear liner against a pedestal jaw roof are taught in U.S. Pat. Nos. 4,034,681 and 4,078,501 to Neumann et al. and 4,192,240 to Korpics, which patents have a common assignee. These disclosed apparatus were to provide improved means for securing a wear liner in the jaw to minimize its movement and to improve the assembly means. The wear liners are provided with downwardly depending legs and stop lugs positioned to inhibit movement of the wear liner, such as in the lateral direction relative to the roof.

U.S. Pat. No. 4,428,303 to Tack illustrates a clip-on pedestal wear plate especially adapted for worn pedestal surfaces. A pair of wear plates, or a single member with a central portion of the plate removed, may be used in the disclosed structure.

All of the above-noted apparatus disclose a journal bearing assembly or an assembly for a rail truck axle end, which assembly is operable in the pedestal jaw. The disclosures recognized the desirability of keeping the truck side frames aligned with each other to avoid truck hunting. The several disclosures provided a plurality of alternative resilient means or structures in the pedestal jaw and around the axle journal bearings, but none of the cited structures addressed the problem of maintaining the bearing adapter, and consequently the axle and side frames, in their aligned positions. Several of the above-noted references specifically utilized elastomeric or resilient components in the pedestal jaw or in association with the journal bearing to accommodate the disturbances and flexing motions experienced by the axles and side frames.

More specifically, it is necessary to provide a bearing and bearing adapter assembly with a moment arm sufficient to resist the torque from the wheels and axles. This torque acts to induce yawing or rotation of the axle inside the side frame pedestal jaw in a horizontal plane, which plane includes the longitudinal axis of the axle. The underlying operational objective of any axle retaining apparatus is to provide an assembly to maintain the axle or axle end in its prescribed relationship to the side frame, which relative position is usually normal to the side frame. The amount of axle rotation considered detrimental to the operation of the railcar truck has been noted as less than one degree (1°) of angular displacement from its reference or as-assembled position. To assist in the assembly of the axle end and bearing, which act as a unit, and to stably retain the unit in the pedestal jaw at its as-assembled position, it is necessary to inhibit horizontal motion of this axle end-bearing assembly in the pedestal jaw along the sideframe longitudinal axis. The bearing adapter and pedestal jaw arrangement should maintain the adapter in its reference position while avoiding yawing of the axle and bearing in the pedestal jaw.

SUMMARY OF THE INVENTION

Each side frame for a railcar truck usually has a pedestal at both of its longitudinal ends with openings or pedestal jaws at each end to receive the journal bearing ends of the axle shafts. The railcar longitudinal axis extends between the opposite ends of the railcar and, the sideframe and truck longitudinal axes are generally parallel to this railcar axis. These journal or wheel bearings are mounted on each axle end and generally secured in bearing adapters in the pedestal jaws. A railcar truck assembly usually has two axles, which extend between a pair of side frames, and are intended to remain aligned and parallel during railcar travel. The above-noted bearing adapters are generally secured in the pedestal jaw by various means, such as interlocking adapter and jaw surfaces. Wear plates are frequently positioned between the adapter and the pedestal jaw roof to minimize wear from the repeated flexing of the adapter in the pedestal jaw during railcar travel.

The present invention provides a bearing adapter in the pedestal jaw, which adapter has vertically extending sides and generally contacts the axle journal bearing, or its bearing race, tangentially at its horizontal diameter. Contact and retention of the journal bearing at its horizontal diameter by the vertically extended bearing adapter legs provides the following: a more secure grasp of the journal bearing by the adapter; a more secure nesting of the adapter in the pedestal jaw; and, a greater resistance to twisting of the adapter, and thus the axle, in the pedestal jaw. These improvements reduce warping and truck hunting, as well as reducing potential wear at the adapter to bearing interface.

It is recognized that truck hunting is not eliminated per se, but reductions are expected in the railcar truck angling. The amount of distortion of the truck geometry from its reference, as-assembled alignment and position, that is distortion where the axles are no longer perpendicular to the axes of the sideframes, is expected to decrease from the present distortion experienced by railcar trucks. Further, the railcar critical speed, that is the speed where truck hunting becomes a negative operating factor, may be expected to increase beyond the normal operating speed of the railcar. In addition, alternative embodiments provide means for avoiding axle and bearing movement transverse to the sideframe longitudinal axis, which thereby avoids metal-to-metal wear.

BRIEF DESCRIPTION OF THE DRAWINGS

In the figures of the Drawing, like reference numerals identify like components and in the drawings.

DETAILED DESCRIPTION OF THE INVENTION

Figure 12:
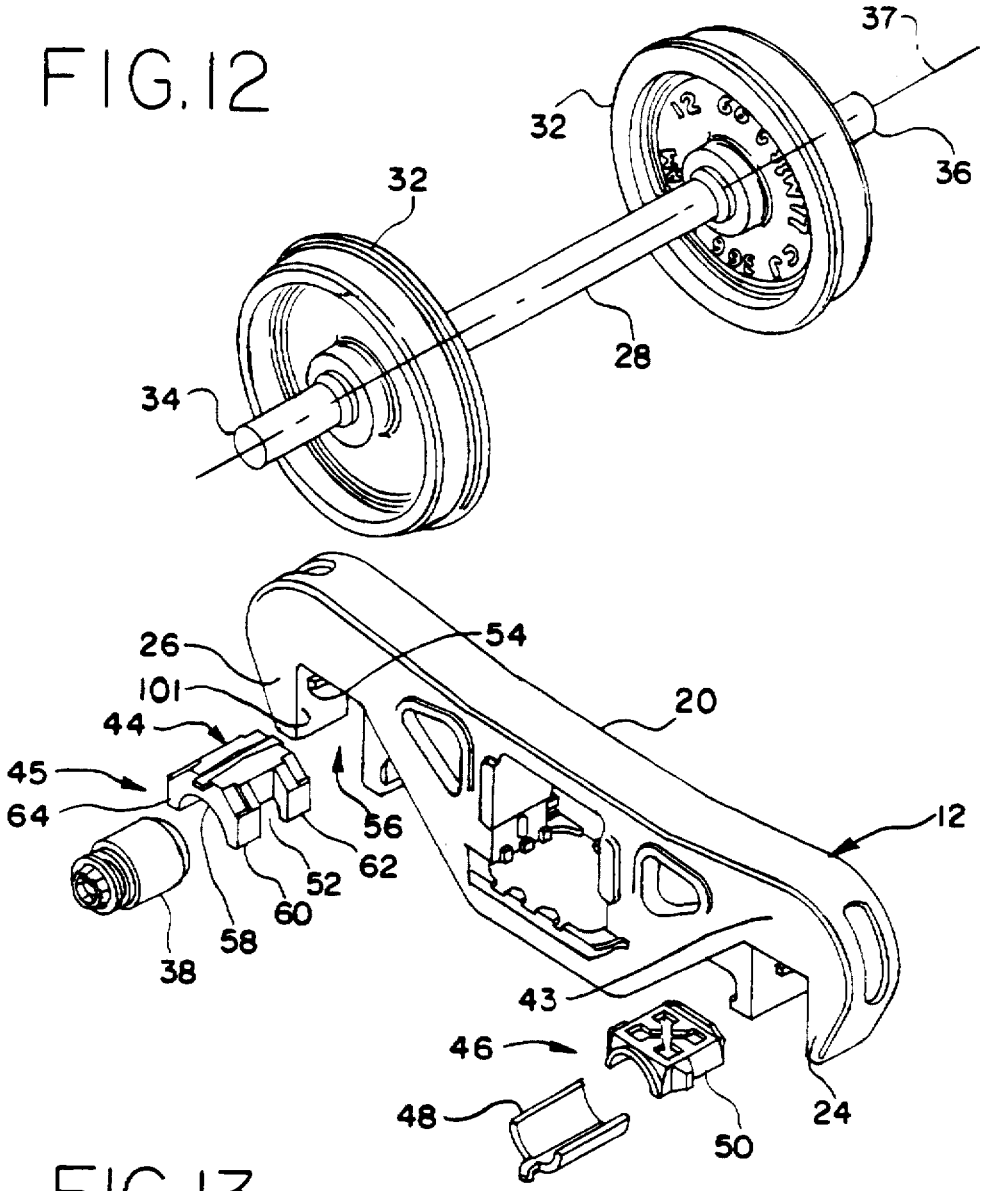
FIG. 12 is an exploded oblique view of a railcar truck side frame, wheel and axle assembly, locked bearing adapter, and journal bearing.
Figure 13:
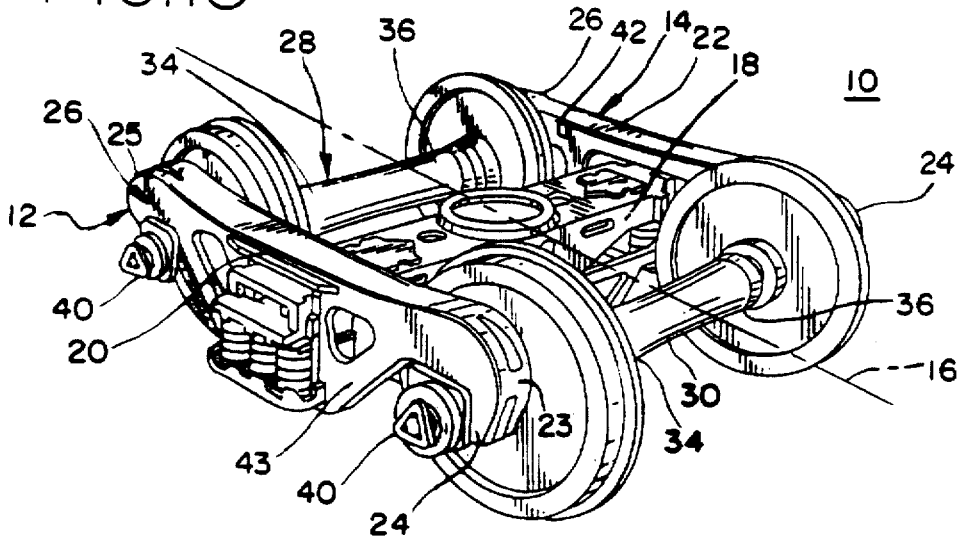
FIG. 13 is an oblique view of a railcar truck.
Figure 14:
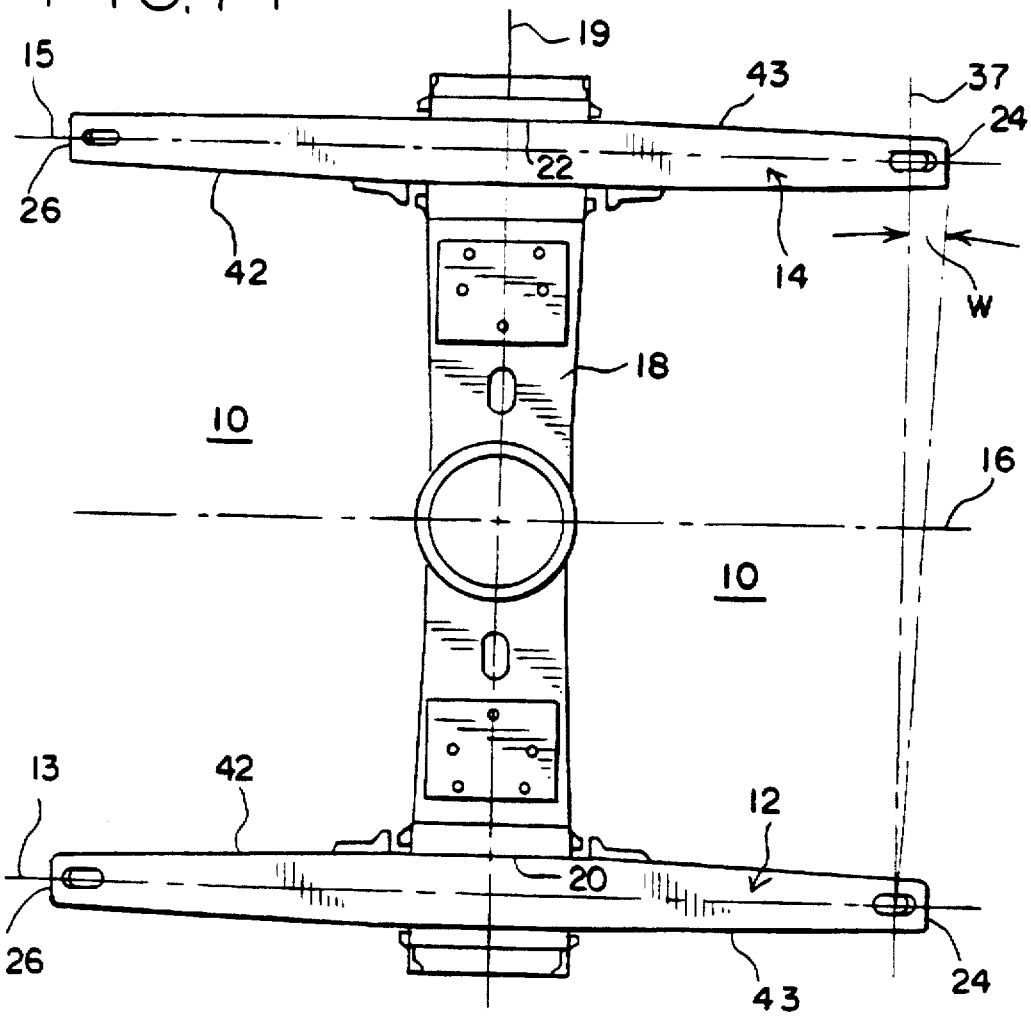
FIG. 14 is a schematic plan view of an exemplary railroad truck assembly.

In FIGS. 13 and 14, railcar truck or truck assembly 10 is illustrated with first side frame 12 and second side frame 14, which side frames 12 and 14 are in a generally parallel relationship to truck longitudinal axis 16. A freight railcar (not shown) is usually provided with a railcar truck 10 at both ends of the railcar. First side frame 12 and second side frame 14 with respective longitudinal axes 13 and 15 are connected by bolster 18 at about their respective midpoints 20 and 22. Bolster 18 with longitudinal axis 19 is generally parallel to first axle 28 and second axle 30. Each of first and second axles 28, 30 have a first end 34, a second end 36 and a longitudinal axis 37, as noted in FIG. 12. Further, bolster 18 is generally transverse to first and second side frames 12, 14, and truck longitudinal axis 16. Each of first and second side frames 12, 14 has a first pedestal jaw 24 and a second pedestal jaw 26 at their respective longitudinal first and second side frame ends 23, 25. The respective side frame first and second pedestal jaws 24, 26 of parallel first and second side frames 12, 14 are generally aligned and have an axle end 34 or 36 of one of axles 28 and 30 nested therein.

Wheels 32 are mounted at each axle end 34 and 36 of each axle 28 and 30 on inboard side 42 of each of side frames 12 and 14 in FIG. 13. As noted in an exploded view in FIG. 12, each wheel 32 is secured on its respective axle end 34, 36 by a journal bearing 38 and an end cap 40.

FIG. 12 illustrates in an exploded view side frame 12 and axle 28 along with ancillary assembly components. More specifically in first bearing arrangement 45, journal or roller bearing 38 and conventional locked bearing adapter 44 are shown at second pedestal jaw 26 of side frame 12. Alternative bearing arrangement 46 at pedestal jaw 24 is noted with journal lubricating pad 48 and solid journal bearing 50, which bearing arrangement 46 is known in the art. Locked bearing adapter 44 has a centrally positioned notch 52 on both longitudinal sides for mating with lugs 54 in pedestal jaw opening 56, which coupling of notch 52 and lug 54 secures adapter 44 in opening 56. A plan view of this lug 54 and notch 52 configuration is noted in FIG. 15.

Figure 2:
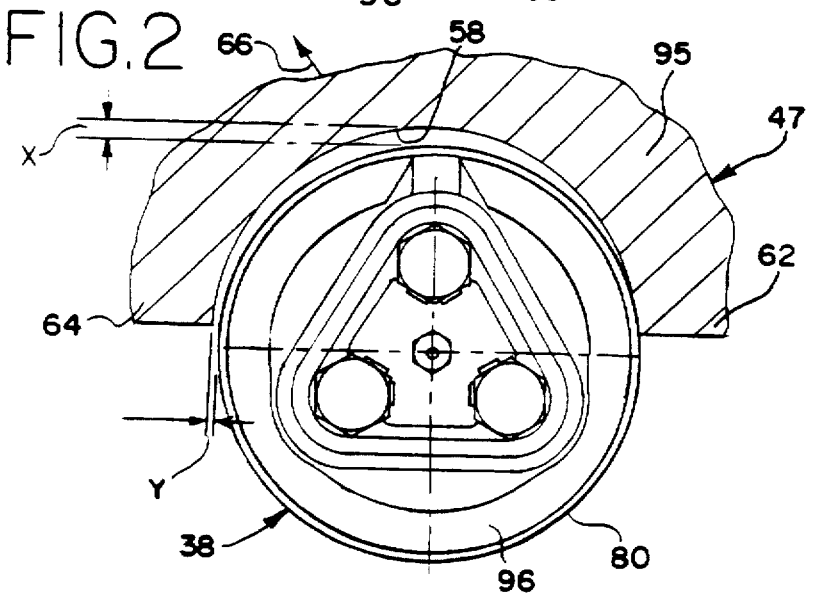
FIG. 2 is an elevational view of a generally conventional bearing adapter and journal bearing assembly with illustrative vertical and horizontal displacements experienced by such apparatus.

After assembly of truck 10, journal bearing 38 on axle end 34 is nestable against arcuate under surface 58 of bearing adapter 44. Journal bearing 38 includes an outer bearing race or cup 168 (cf. FIG. 4A) to secure the individual bearings within the bearing assembly, and reference to journal bearing 38 is to the bearing assembly. Bearing adapter 47 or 44 and bearing 38 in FIGS. 2 and 12, respectively, are illustrative of an extant bearing structure. In FIG. 2, the downwardly extending side arms 62 and 64 of adapter 47 only capture a portion of the circumferential surface of journal bearing 38. In the configuration of bearing 38 and adapter 47 of FIG. 2, movement of truck 10 along railtracks causes perturbations in truck 10 initially producing vertical displacement of adapter 47 relative to journal 38, which allows longitudinal deflections of axles 28 and 30 along side frame axes 13 or 15. These perturbations and deflections can produce resultant displacement of adapter 47, as noted by vector arrow 66 in FIG. 2, which vector has a vertical displacement component 'x' and a longitudinal displacement component 'y'. As noted above, the resultant displacement of axles 28 and 30, and adapters 47 or 44 is related to the truck hunting and warping phenomena.

Although each of side frames 12 and 14 have a first pedestal jaw 24 and a second pedestal jaw 26, only one of pedestal jaws 24, 26 and the associated wheel bearing 38 and bearing adapters 44 or 47 will be described. It will be understood that the description of the wheel bearing and bearing adapter at one pedestal end is applicable to each pedestal jaw in a truck assembly 10.

Figure 1:
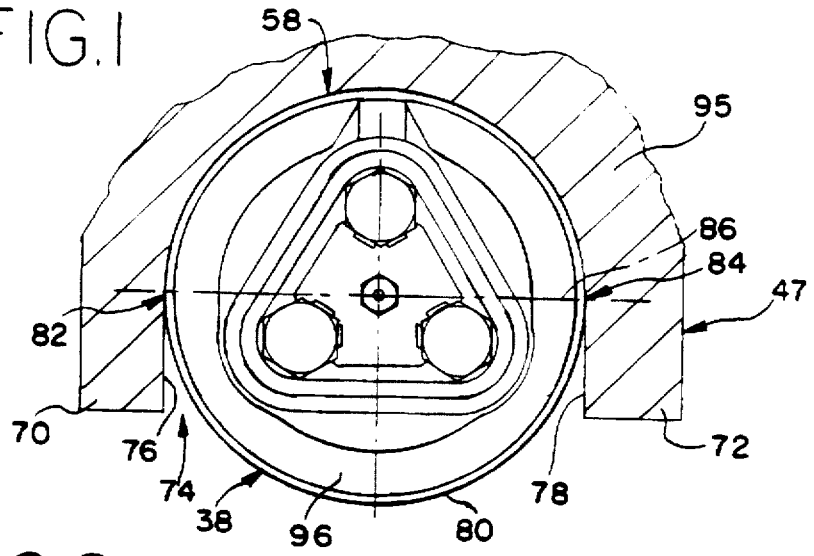
FIG. 1 is an elevational view in partial cross-section of a bearing adapter with tangential contact at the horizontal diameter of the journal bearing.

FIG. 1 is a conceptual illustration of a bearing adapter or weight-bearing apparatus 47 to be nested in a pedestal jaw 26 for securing journal bearing 38 and its mated axle end 34 or 36. Bearing adapter 47 has a first vertically downward extending arm 70 and a second vertically downward extending arm 72, which arms 70 and 72 cooperate with arcuate under surface 58 to provide a u-shaped slot 74 for journal bearing 38. Slot 74 is preferably sized to securely mate with bearing 38. Inner walls 76 and 78 of slot arms 70 and 72, respectively, are tangential to bearing outer surface 80 at opposite outer points 82 and 84 of bearing horizontal diameter 86. Arms 70 and 72 extend vertically downward beyond tangential contact with outer points 82 and 84 to securely capture bearing 38 within adapter 47. In this illustration, bearing adapter 47 functions as the locking plate, the adapter and the load bearing apparatus. Thus, adapter 47 captures and secures bearing 38 and axle 28 to securely maintain them in pedestal jaw 24 or 26. In this configuration, adapter inner walls 76, 78 will maintain contact with bearing surface 80 at diameter 86 during vertical movement of adapter arms 70 and 72, and thus adapter 47 continues to inhibit longitudinal displacement component "y" noted in FIG. 2, which movement would be parallel to sideframe 12 or 14.

Figure 4:
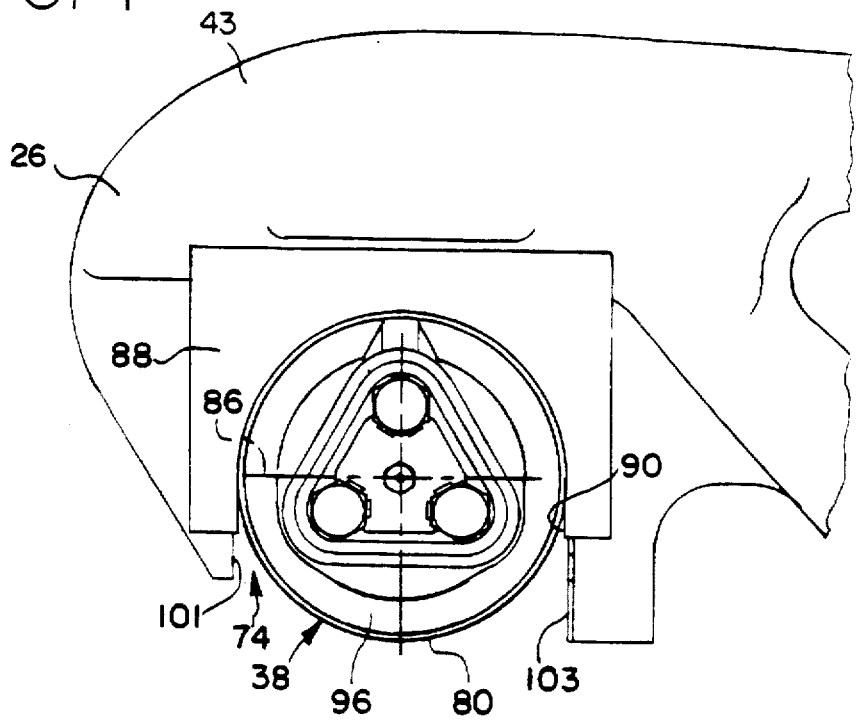
FIG. 4 is an elevational view of a pedestal jaw with a bearing adapter-locking plate assembly and a journal bearing positioned in the pedestal jaw.
Figure 7A:
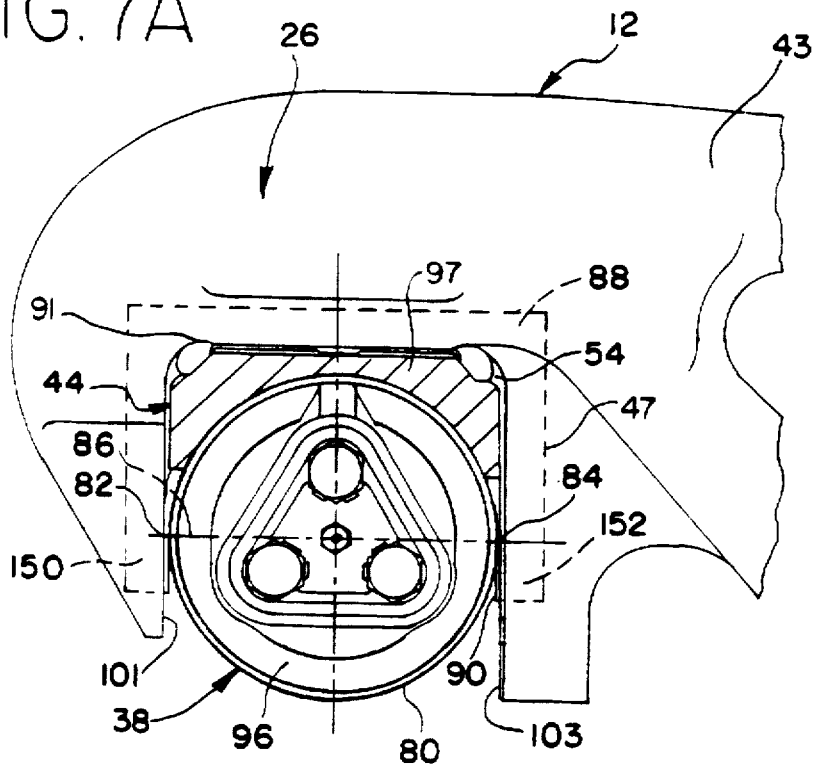
FIG. 7A is an elevational view of a bearing adapter-locking plate assembly as in FIG. 4 and further including an auxiliary component as in FIG. 7, which auxiliary component carries only part of the vertical force in this embodiment.
Figure 7:
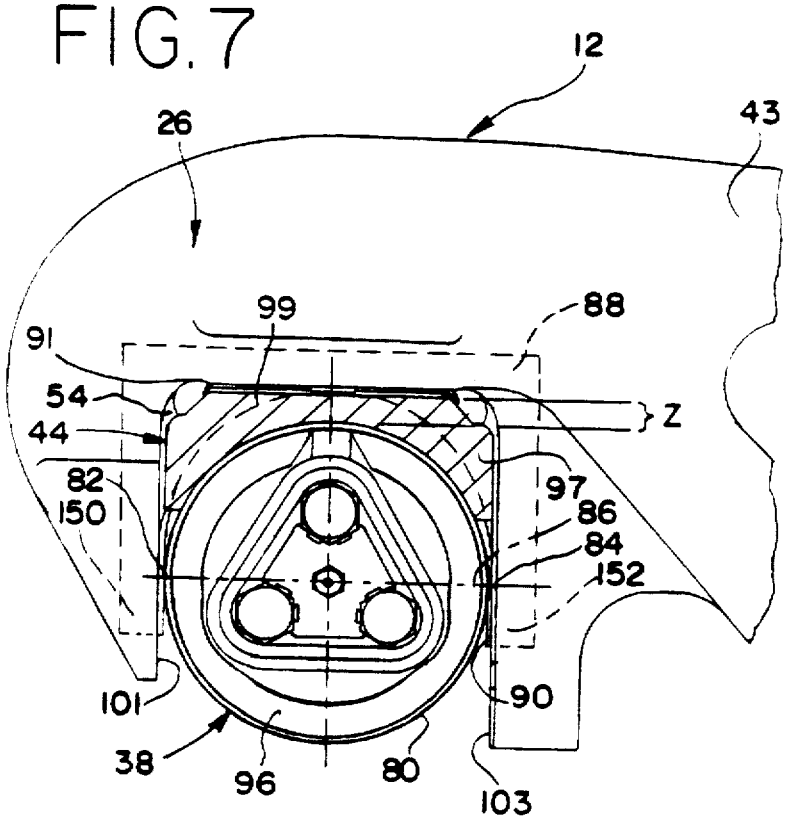
FIG. 7 is an end view of an alternative embodiment of a bearing adapter-locking plate assembly with separate components, which assembly includes an auxiliary component for transfer of all the vertical forces.
Figure 7C:
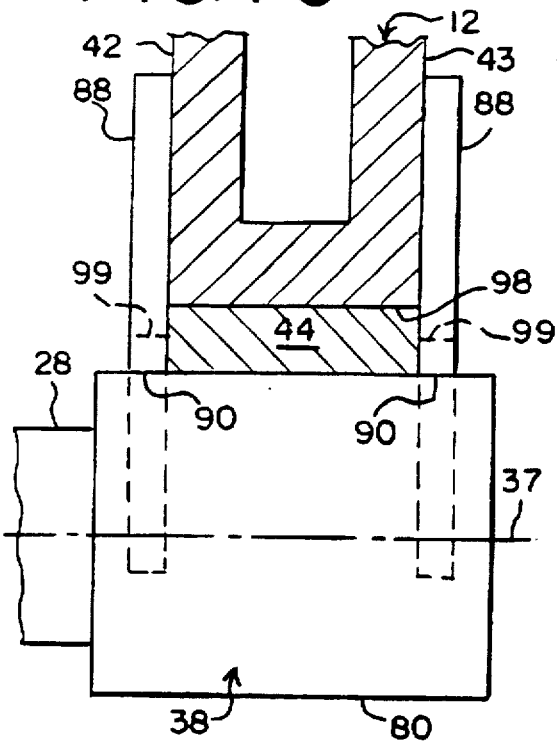
FIG. 7C is a diagrammatic cross-sectional view of a sideframe pedestal jaw, an axle and journal bearing, which view includes the bearing adapter-locking plate assembly embodiments as in FIGS. 4, 7 and 7A.
Figure 7D:
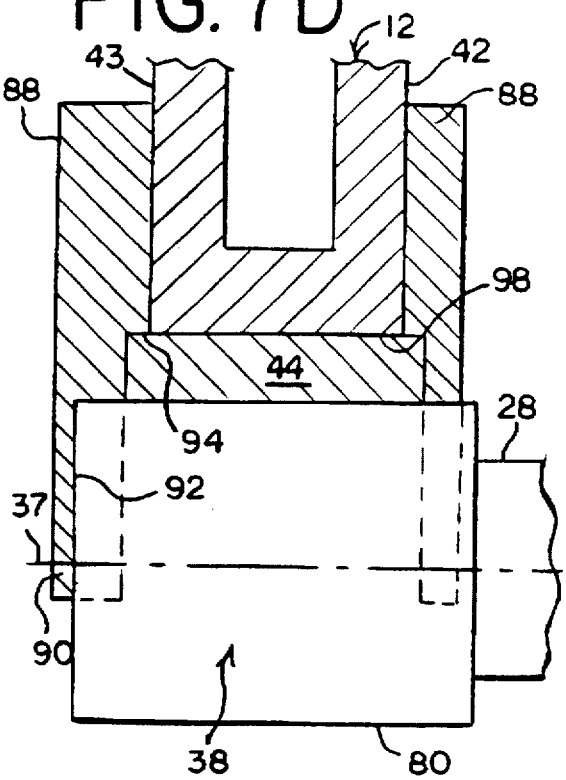
FIG. 7D is a diagrammatic cross-sectional view of a sideframe pedestal jaw, an axle and journal bearing, which includes the bearing adapter-locking plate assembly embodiment as in FIG. 5.
Figure 7B:
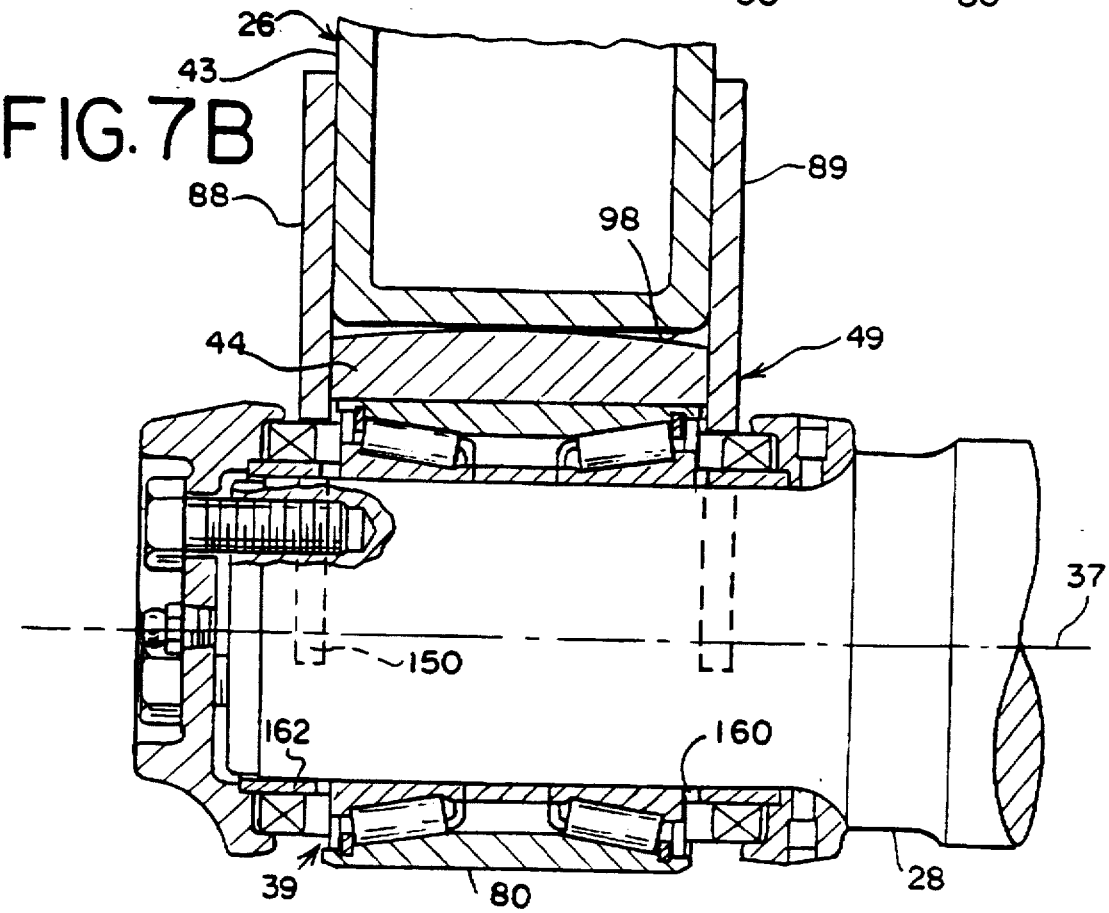
FIG. 7B is a cross-sectional view of a bearing adapter-locking plate assembly as shown in FIG. 7A with an auxiliary component.

Utilization of locking plate 88 with bearing or bearing assembly 38 and adapter 44 is shown in FIGS. 4, 4A, 5, 5A, 7, 7A, 7B, 7C and 7D. The several figures illustrate alternative embodiments or structures, and FIGS. 7C and 7D depict the relationship between these embodiments. In the embodiment of FIGS. 4 and 7A, which FIG. 7A is an end view of pedestal jaw 26 and axle 28, locking plate 88 is noted in dashed outline. In the embodiment of FIGS. 7, 7A and 7B, locking plate edge 90 is in proximity to bearing outer surface 80 at diametral contact points 82 and 84, which are about the outer points of a horizontal diameter 86 of the bearing end face. Bearing adapter 44 in FIGS. 7, 7A and 7B broadly has a similar structure to adapter 44 of FIG. 12, which adapter arrangement includes notch 52 and lugs 54 in opening 56.

Locking plate 88 on outboard sideframe surface 43 in FIG. 7A has first sidearm 150 and second sidearm 152 with arcuate locking plate edge 90 joining sidearms 150, 152, which sidearms 150, 152 provide the side support for bearing assembly 38 at outer horizontal diameter points 82 and 84. In this embodiment, arcuate edge 90 is in contact with outer surface 80 of bearing 38 and shares the load or force bearing function with bearing adapter 44. Wear plate or auxiliary component 91 is illustrated as an independent component, but it may also be incorporated with adapter 44 and locking plates 88 and 89 in a single cast or machined part. Locking plate 89 is similar to locking plate 88 but mounted on inboard surface 42, and it may be altered to conform to the available structure and contour of the sideframe. In FIG. 7, locking plate 88 includes an arcuate cutout providing a separation distance 'z' between the bearing outer surface 80 at the upper portion of bearing assembly 38 and the arcuate locking plate edge 90 at its vertical upper edge. As in FIG. 7A, locking-plate side arms 150 and 152 maintain tangential contact with bearing outer surface 80 at horizontal diameter endpoints 82 and 84, however, relief section or separation distance 'z' provides adequate displacement for side frame 12 to rock or tilt about side frame longitudinal axis 13 or 15, that is a rotational movement between side frame, outboard wall surface 43 and inboard wall surface 42. Allowance for the side frame rocking motion avoids any potential binding between edge 90 of locking plates 88 or 89, which is noted on inner surface 42 of FIG. 4A, and bearing outer surface 80 as rail truck 10 traverses rail tracks. In this embodiment, relief section 'z' avoids vertical loading of locking plates 88 or 89 and all vertical loads or forces are borne by adapter 44.

Figure 8:
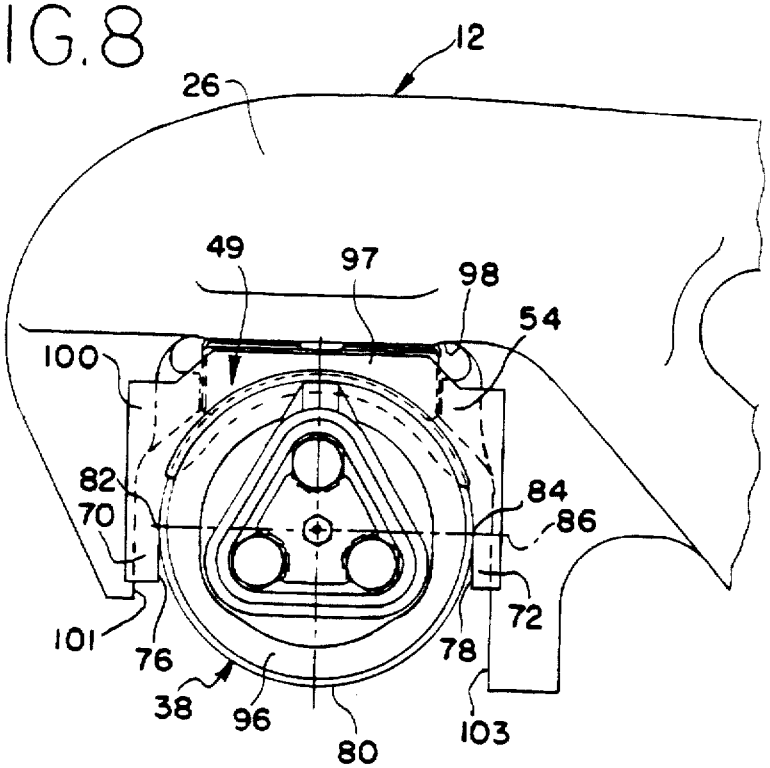
FIG. 8 is an axle end view of a one-piece bearing adapter-locking plate assembly positioned in a pedestal jaw with securing means.

An alternative embodiment is shown in an elevational view in FIGS. 7B and 8 with a locked bearing adapter alternate structure 49, which may also generally be compared to adapter 44 of FIG. 12. The wear plate or auxiliary component is incorporated with adapter 44 and locking plates 88 and 89 in a single cast or machined part. In FIG. 7B, adapter 49 includes outboard locking plate 88 and inboard locking plate 89 as a one-piece integrated component. Adapter 49 has downwardly extending arms cooperating to define notches 52 (cf., FIGS. 12 and 15) for mating with lugs 54 in opening 56, which arms are similar to arms 60, 62 and 64 noted in FIG. 12, as well as the fourth and similar arm 63 not visible in FIG. 12. However, the structure of adapter 49 includes inner walls 76, 78 of respective downwardly extending arms 70 and 72 tangentially contacting outer bearing surface 80 at horizontal bearing diameter 86. The upper portion of adapter 44 or adapter structure 49 is firmly positioned and maintained against pedestal opening roof 98. Locking plate 100 in FIG. 8, which is similar to locking plate 88 and is separately designated to distinguish its structure, is integral with adapter 49 and secured to pedestal jaw 26 by means known in the art. A second locking plate, similar to locking plate 89 above in FIG. 4A, is positioned inboard of side frame 12.

In the embodiment of FIGS. 4 and 7A, mated adapter 47 and bearing 38 are secured in pedestal jaw 26 by locking plate 88, which can also be considered to illustrate the concept of carrying the vertical load by locking plate 88 without an auxiliary adapter 44. Plate 88 is secured to side frame 12 at pedestal jaw end 26 by means known in the art such as welding, brazing, rivets or bolts.

Figure 4A:
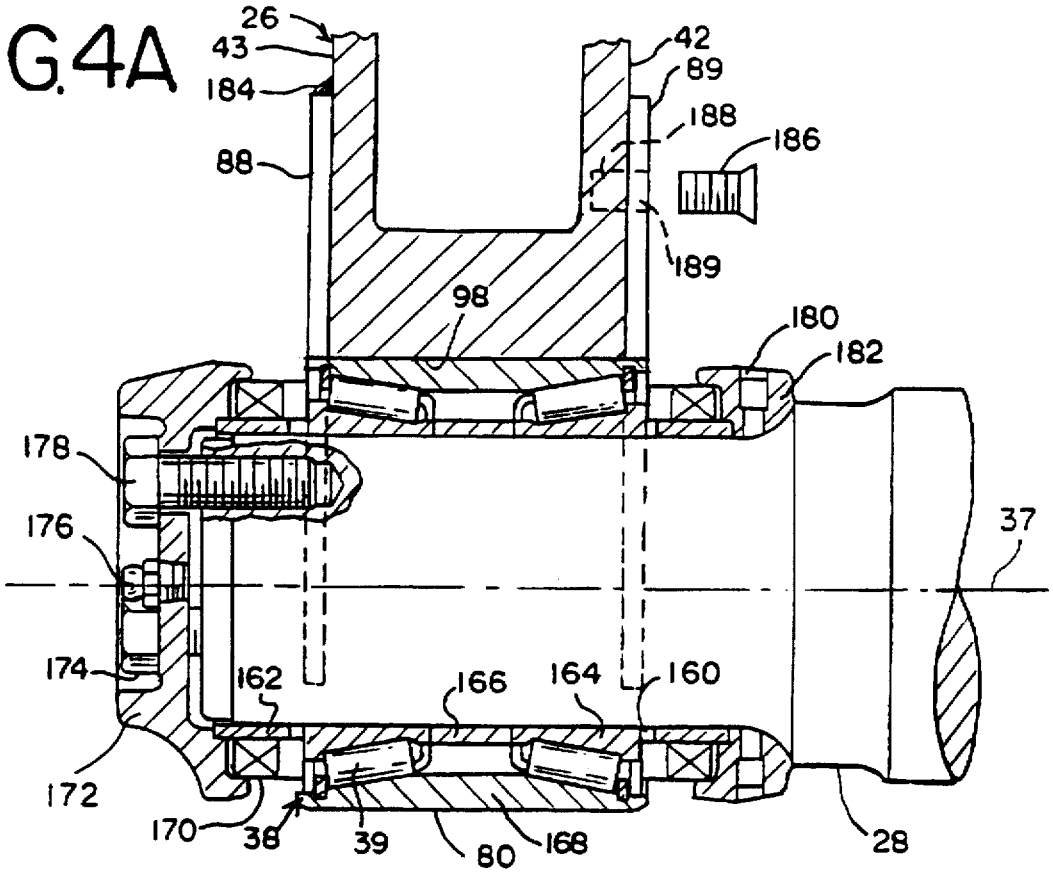
FIG. 4A is an elevational view in partial cross-section of the bearing and bearing adapter-locking plate in FIG. 4 taken along an axle longitudinal axis.
Figure 5A:
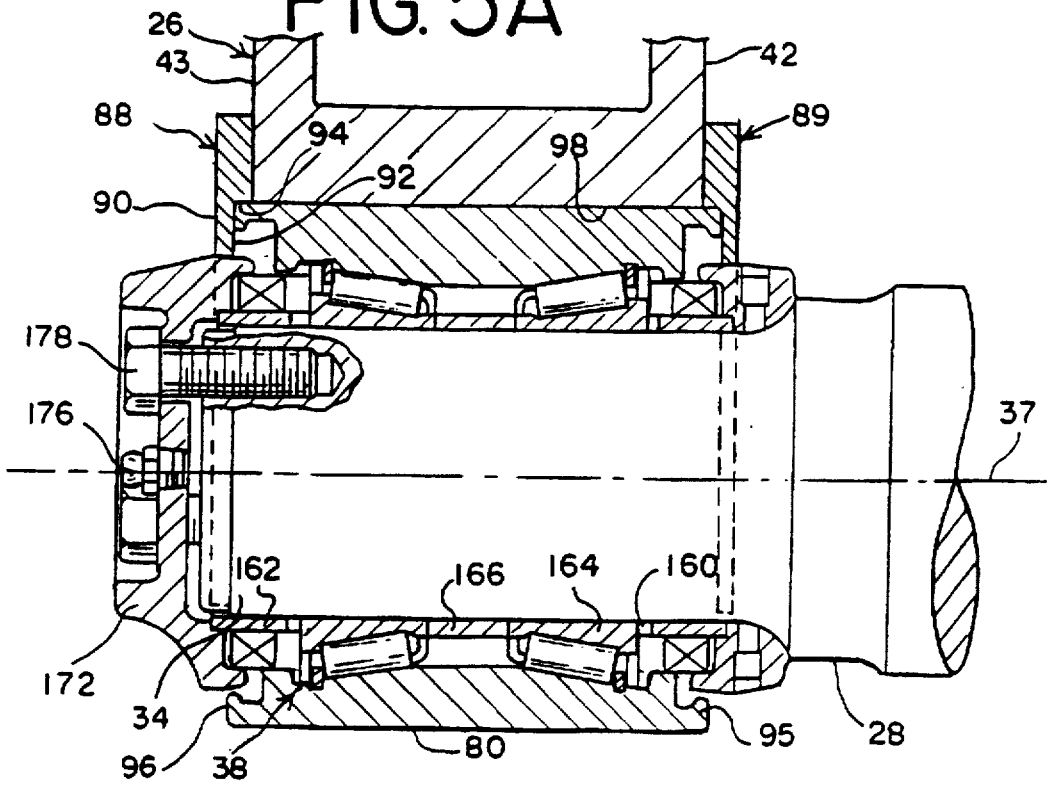
FIG. 5A is a longitudinal elevational view in partial cross-section of a bearing adapter-locking plate assembly as illustrated in FIG. 5.

The exemplary structure of FIGS. 4 and 7A is shown in cross-sectional detail in FIG. 4A with inboard locking plate 89 secured to inboard surface 42 and outboard locking plate 88 secured to outboard surface 43 of side frame 12 or 14. In this illustration, roller bearing assembly 38 has roller bearings 39 and bearing outer surface 80. Locking plates 88 and 89 firmly secure bearing assembly 38 in pedestal jaw opening 56 between inboard locking plate 89 and outboard locking plate 88 and against pedestal jaw roof 98.

Bearing assembly 38 of FIG. 4A includes inboard seal wear ring 160 and outboard seal wear ring 162; cone and roller assembly 164; cone spacer 166; bearing cup 168; seal 170; end cap 172; locking plate 174; lubricant fitting 176; cap screw 178; vent fitting 180; and, backing ring 182. This structure is merely illustrative of a roller bearing journal assembly 38, but clearly demonstrates the multiplicity of elements associated with adapter 44 or 47 at pedestal jaws 24, 26. Further, alternate securing means for locking plates 88 and 89 include weldment 184 and screw 186, which screw 186 is matable into aperture 188 of side frame 12 through port 189 of plate 89.

Figure 5:
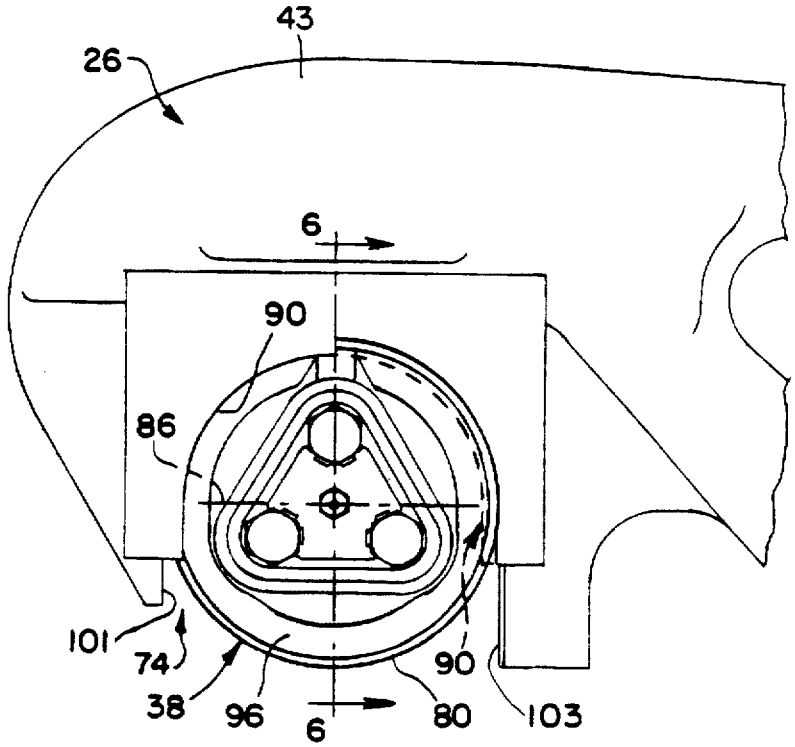
FIG. 5 is an elevational view of a journal bearing in a pedestal jaw with a bearing adapter-locking plate assembly and a retention flange for restriction of journal motion perpendicular to the longitudinal axis of the side frame.
Figure 6:
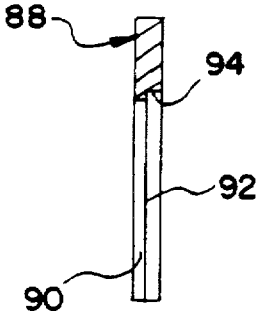
FIG. 6 is a side view of the locking plate of FIG. 5 taken along the line 6—6.

In the embodiment illustrated in FIG. 5, locking plate inner edge 90 extends over bearing 38 at outboard surface 43 to securely anchor bearing 38. A second locking plate (not shown), which is similar to locking plate 89 in FIG. 4A, may be secured to inner or inboard surface 42 of side frame 12 to securely hold bearing 38 in opening 74. In an alternative embodiment shown in FIGS. 5, 5A and 6, locking plate 88 includes a flange 92 and shoulder 94 arrangement inboard of locking plate inner edge 90 to secure bearing 38 and axle 28 in pedestal jaw opening 74. In this embodiment, axle end 34 or 36 extends beyond bearing assembly 38 an incremental distance. Flange 92 overlaps the outer edge of bearing lip 95 and bearing 38 at the intersecting edge between bearing outer face 96 and bearing outer circumferential surface 80 to securely maintain bearing 38 in pedestal jaw opening 74.

In FIG. 7C, the embodiments of FIGS. 4, 7 and 7A are overlayed in a cross-sectional arrangement of a sideframe, axle and journal bearing, and provide an illustration of the general relationship between these several embodiments. In this illustration, locking plates 88, as shown in FIG. 4, are provided on both inboard surface 42 and outboard surface 43 of sideframe 12. Auxiliary bearing adapter 44 is interposed between outer surface 80 of journal bearing 38 and the outer surface of pedestal jaw roof 98. Locking plates 88 extend below axle center line or axis 37 on journal bearing 38. In the solid line configuration, locking plates 88 would contact bearing outer surface 80 to provide at least a sharing of the load on bearing adapter 44. However, dashed lines 99, which are noted in FIG. 7, illustrate the arcuate relief section in locking plates 88 of such FIG. 7. In this embodiment of FIG. 7, all the load is borne by the bearing adapter 44.

FIG. 7D shows the embodiment of FIG. 5 on the cross-sectional view of sideframe 12, axle 28 and journal bearing 38. Although this illustration could have been provided in conjunction with the embodiments of FIG. 7C, it is separately shown for clarity. In FIG. 7D, locking plates 88 include flange 92 with shoulder 94 and demonstrates bearing adapter 44 extending beyond inboard and outboard sideframe surfaces 42, 43 and nesting against locking plates 88 and particularly flanges 90. Inside locking plate 88 could also incorporate flange 92 on such locking plate 88, which would further restrict horizontal motion between a side frame and axle.

Figure 9:
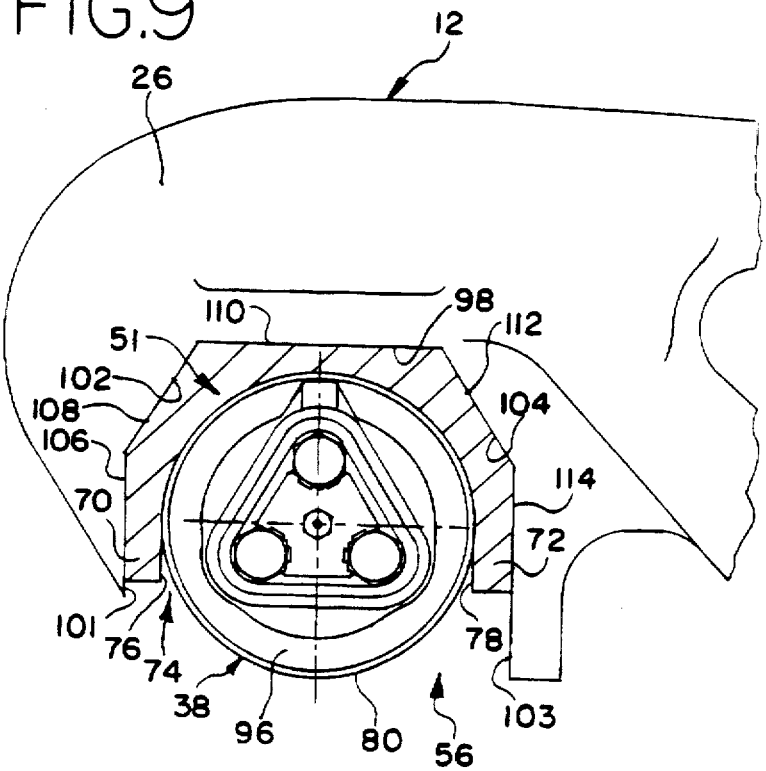
FIG. 9 is an axle end view of a one-piece, bearing adapter positioned in a pedestal jaw, which is retained therein by a tight mechanical fit and gravity.

An alternative illustration of a bearing adapter structure utilizing extended arms for securely grasping and retaining bearing 38 is shown in FIG. 9. In this figure, pedestal jaw opening 56 includes downwardly vertical sidewalls 101 and 103 connected to roof 98 by sloping segments 102 and 104, respectively. Bearing adapter 51 in this embodiment may be cast, formed or machined to provide tight conformation of its mating or contacting surfaces 106, 108, 110, 112 and 114 to vertical sidewall 101, sloping segment 102, roof 98, sloping segment 104 and vertical sidewall 103, respectively. This tightly fitted arrangement provides intimate contact between bearing 38, adapter 51, pedestal jaw 26 and side frame 12, which fitted arrangement readily accommodates transfer of forces from the interaction of wheels 32 and the rail track. Bearing adapter 51 could also be retained in position by stops, keys or other means known in the art.

Figure 10:
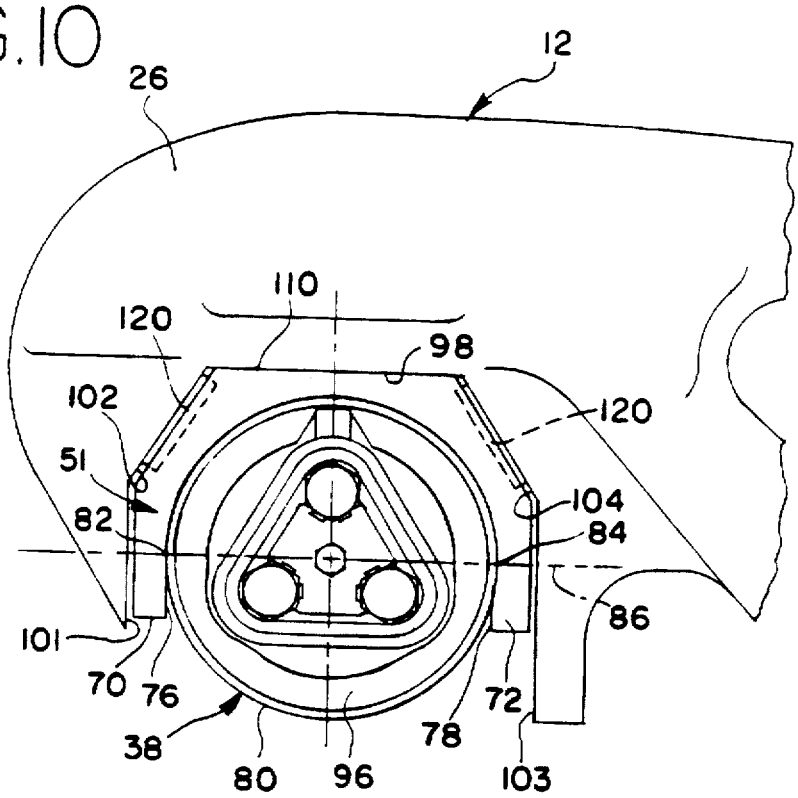
FIG. 10 illustrates a one-piece, bearing adapter as shown in FIG. 9 with a spring pad therein.

In FIG. 10, one-piece locking bearing adapter 51 has spring pads 120 mounted on sloped segments 102 and 104, which pads 120 are a material with a high spring rate, such as rubber or an elastomeric material. Pads 120 extend into pedestal-jaw opening 56 to assure a tight fit between adapter 51 and pedestal jaw 26. Adapter vertical extending arms 70 and 72 are noted as tangential to contact points 82 and 84 at horizontal axis 86. The elastomeric material, such as high molecular weight polyurethane, is either fully compressed at assembly to inhibit any unwanted deflection during operation, or it may be incompressible after assembly.

Figure 11:
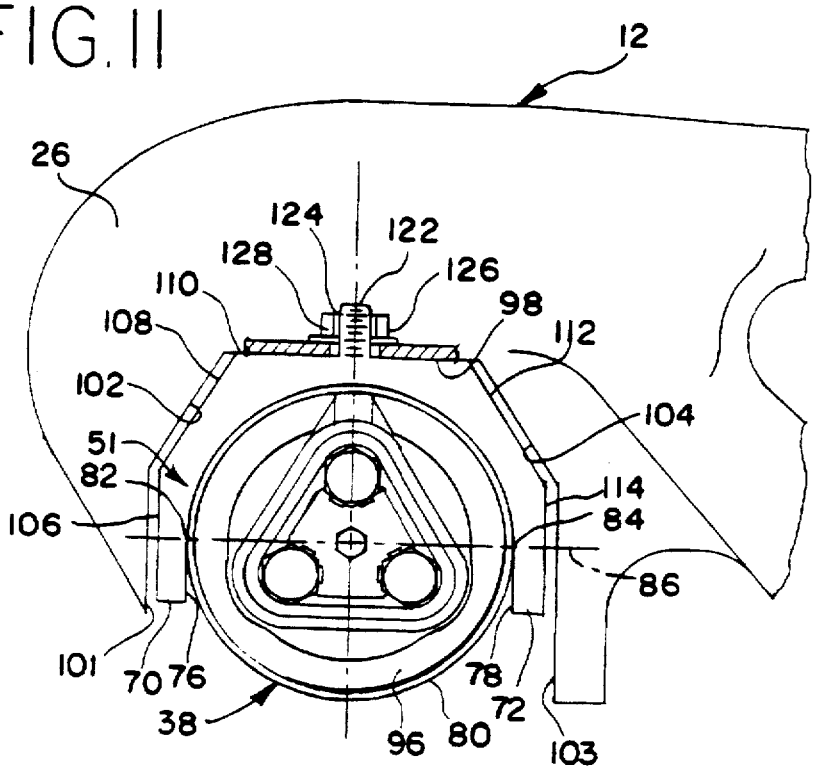
FIG. 11 is an alternative embodiment of a one-piece bearing adapter as shown in FIG. 9, which adapter is rigidly secured by bolts.

In FIG. 11, one-piece bearing adapter 51 with extending arms 70 and 72 includes threaded stud 122 normally extending upward from upper portion or contacting surface 110 into aperture 124 in roof 98, which aperture and roof have countersunk port 126 to receive nut 128 for mating with threaded stud 122. Therefore, bearing adapter 51 with vertical extending arms 70 and 72 tangentially contacting bearing 38 at contact surfaces 82 and 84, respectively, is securely fastened to side frame 12 and is operable to rigidly secure bearing assembly 38 and axle 28 in pedestal jaw 26 to minimize railcar truck warping and hunting.

Figure 3:
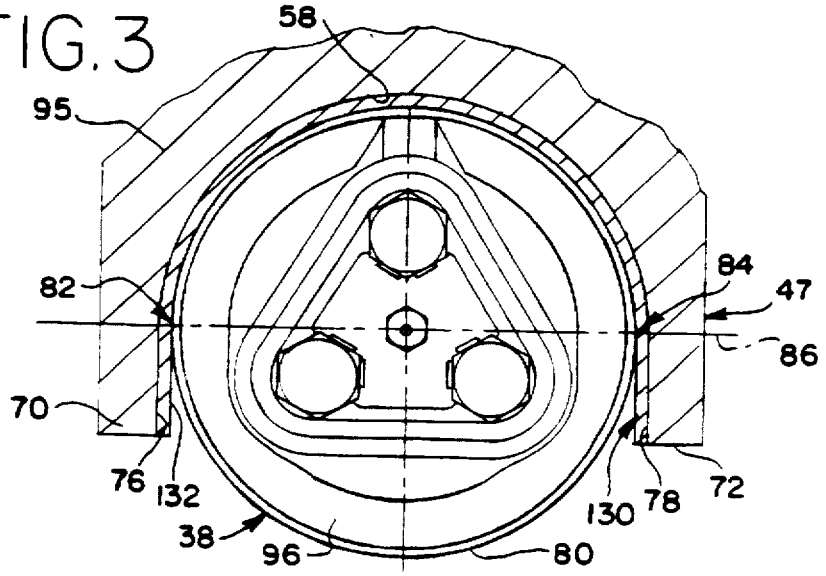
FIG. 3 is an elevational view in cross-section of a bearing adapter, as shown in FIG. 1, with a low-friction lining interposed between the journal bearing and the adapter sidewall.

FIG. 3 illustrates an alternative conceptual embodiment to the above-noted structures, which embodiment includes a low-friction lining 130 between journal bearing assembly 38 and any of bearing adapters 47 and 51. This figure is shown with the structural illustration of FIG. 1 for demonstrative purposes and not as a limitation. In this figure, adapter 47 includes low-friction liner 130, which usually has a uniform thickness, interposed between journal bearing outer surface 80 and adapter walls 76, 58 and 78. Therefore, tangent contact points 82, 84 at horizontal diameter 86 appear at inner wall surface 132 of liner 130. Thus, liner 130 reduces wear from motion between bearing assembly 38 and adapter 47 or 51(cf., FIG. 11), which motion is perpendicular to the longitudinal axis 13 of side frame 12; allows and enhances the amount of bearing-to-adapter motion parallel to the bearing assembly centerline and perpendicular to side frame longitudinal axis 13 or 15; and, improves ease of assembly as the resilient surface will permit assembly of hardware mismatch from manufacturing tolerance buildup. However, as noted above, liner 130 must be fully compressed at assembly to insure a tight fit between adapter 47 and bearing assembly 38.

In operation, truck 10 is susceptible to perturbations and disturbances induced by the track structure, such as rail joints, crossovers and "frogs", as well as any random hazards, which perturbations can induce vertical, horizontal and lateral fluctuations and movements in axles 28 and 30, bearing assemblies 38 or associated bearing adapters 44, 47, 49 or 51, and cause parallelogramming in side frames 12 and 14. In FIG. 14, the potential relative horizontal angular displacement between sideframes 12 and 14 at pedestal jaws 24 is noted by the exaggerated angle 'w'. However, to reduce truck hunting, the angular displacement 'w' must be less than 1°, and preferably less than 0.1°.

The several embodiments of the invention taught and described above provide means for securely maintaining each bearing and axle end in their as-assembled reference position, which is generally normal to sideframes 12 and 14. The several illustrated apparatus include means for providing the following: an integrated adapter; a locking plate or plates in cooperation with a bearing adapter; an adapter with a locking plate to share the vertical load; and, an adapter with a locking plate allowing the adapter to carry all of the vertical load. These vertical loads or forces are transmitted to the sideframe, axle and railcar from the wheels and axle, but the bearing adapter, such as adapters 44, 47 and 51, is firmly anchored in position within the pedestal jaw to inhibit movement of the axle and bearing, and consequently to inhibit truck hunting.

Figure 15:
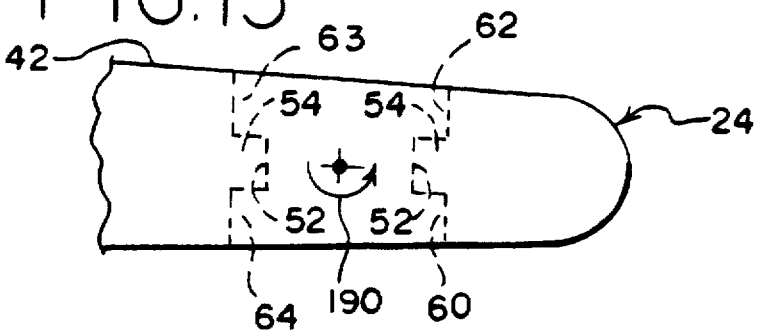
FIG. 15 is an enlarged plan view of an exemplary side frame end and pedestal jaw.

The effects of the vertical loading from the railcar and the vertical or horizontal displacement of axle ends 34, 36 in pedestal jaws 24, 26 is to induce a torsional load in the pedestal jaw. The locking plate-bearing adapter assembly firmly secured in the pedestal jaws provides a resisting torque to the rotational moment, which moment is depicted in FIG. 15 at arrow 190. The resisting torque prevents yawing or horizontal rotation of the axle end, and consequently securely maintains the axle and sideframes in their relative as-assembled positions, inside the pedestal jaw opening, which is about 90°, or normal, to each other. The proscribed rotation of axle ends 34, 36 in a pedestal jaw is illustrated in FIG. 15 by arrow 190. All of the above-noted several disturbances to the alignment of the various components at a static position can induce undesirable movement in the components relative to each other.

As noted above, reduction in the movement of axles 28 and 30 longitudinally with respect to side frame axes 13 or 15, as well as reducing the rotational moment at the axle end, can aid in reducing the threshold speed for truck warping and hunting. The above-described locking plates 88 and 89, and bearing adapters 44, 47 and 51 with extended arms 70 and 72 capture journal bearing 38 against inner arcuate surface 58 at least circumferentially across horizontal diameter 86 of bearing 38. Further, utilization of locking plates 88, 89 with adapter 44, 47 or 51 provides similar means of retention of an axle and bearing in a pedestal jaw. This approximate semicircular capture of the generally cylindrical journal bearing assembly 38 allows bearing adapter 44, 47 or 51 to securely grasp and retain bearing assembly 38 and its associated axle 28 and 30 in pedestal jaw 24 or 26. Similar capture and retention of the bearing and axle ends in all of the pedestal jaws of the parallel sideframes generally secures the axles and sideframes in the as-assembled reference positions. Secure retention of journal bearing assembly 38, and axles 28 and 30 minimizes longitudinal deflection of axles 28 and 30 to less than 0.25°, that is relative movement of one axle end in a sideframe pedestal jaw with respect to the other axle end or sideframe, which has been found to significantly enhance the ability of the railcar truck to resist truck hunting. Secure retention of journal bearing 38 appears to increase the initiation speed for truck hunting beyond the normal operating speeds of most railcars.

The present invention provides a bearing adapter assembly that may be conveniently nested in a pedestal jaw 26 of a railcar truck sideframe 12, 14. However, it may also be secured to or cooperate with inner and outer surfaces 42 and 43 of sideframes 12 and 14 through a locking plate 88 or 89 to secure the adapter against rotational motion in the pedestal jaw, which in turn dramatically inhibits rotation of the bearing and axle end of the railcar truck axle nested against the bearing adapter. Although the invention can provide securement of the adapter by extending the vertical arms of the pedestal jaw, the preferred embodiment provides securing the adapter by mechanically coupling the adapter to the sideframe sidewall or to the internal wall of the pedestal jaw opening. Anchoring the adapter in the pedestal jaw opening constrains the movement of the adapter and consequently reduces movement of the axle end and journal bearing secured therein. Further, securing the adapter and the locking plate to the pedestal jaw and the sideframe acts to maintain the reference position relationship between the adapter and sideframe sidewalls, that is generally normal. Maintenance of the physical relationship between the bearing assembly and the pedestal jaw acts to maintain the parallel relationship between the sideframes of a railcar truck and the generally normal relationship between the axles and the sideframes to thereby avoid truck hunting.

As indicated above, the extending arms of the bearing adapter and locking plate assemblies 47 and 51 are noted as weight-bearing apparatus whether the assembly is a bearing adapter, a locking plate or the mated bearing adapter-locking plate. The components are operable as the noted assembly to receive the weight of the railcar and to retain the bearing in position in the pedestal jaw.

While only particular embodiments of the invention have been described and claimed herein, it is apparent that various modifications and alterations of the invention may be made. It is the intention in the appended claims to cover all such modifications and alterations as may fall within the true spirit and scope of the invention.

We claim:

1. A bearing adapter assembly to rigidly retain a bearing assembly and axle end of an axle in a railway truck sideframe pedestal jaw, each said sideframe having a first longitudinal axis, a first pedestal jaw, a second pedestal jaw, a first outer wall surface and a second outer wall surface with a wall thickness between said first and second outer wall surfaces, each said first and second pedestal jaw having an upper wall, a first sidewall and a second sidewall cooperating to define a pedestal-jaw opening generally opposite said upper wall, said pedestal-jaw upper wall, first sidewall and second sidewall having a pedestal-jaw surface, said bearing adapter assembly positionable in said opening, said axle being generally cylindrical with a second longitudinal axis, a cross-sectional diameter, a first end and a second end, said second longitudinal axis generally transverse to said first longitudinal axis at a reference position, a bearing assembly mounted on each said axle first and second end, said bearing assembly being generally annular with a horizontal diameter generally parallel to said axle cross-sectional diameter and having an end face with an outer circumference, said bearing horizontal diameter generally normal to and extending through said axle longitudinal axis and intersecting said bearing outer circumference at a first contact point and a second contact point, said axle longitudinal axis and said horizontal diameter cooperating to define a plane, said bearing adapter assembly comprising:

an upper portion, a first sidewall and a second sidewall, each said upper portion, first sidewall and second sidewall having an outer surface and an inner surface, said adapter assembly positioned in said pedestal-jaw opening with said assembly outer surfaces contacting said pedestal-jaw upper wall, first sidewall and second sidewall pedestal-jaw surfaces, and approximately extending between said sideframe first and second outer wall surfaces;

means for rigidly securing said assembly to said sideframe in said pedestal-jaw opening;

said adapter assembly inner surface contoured to receive said bearing outer circumference, which bearing and axle ends are nestable against said contoured inner surface, said adapter assembly first-sidewall inner surface tangentially contacting said bearing circumference at about one of said first and second contact points, and said assembly second sidewall inner surface tangentially contacting said bearing circumference at about the other of said first and second contact points to securely grip and retain said bearing and axle end against motion along said first longitudinal axis and against rotational motion in a plane defined by said sideframe first longitudinal axis and said second longitudinal axis.

2. A bearing adapter assembly as claimed in claim 1, wherein said adapter assembly has an outer end face and an inner end face, said adapter assembly inner end face and outer end face approximately aligned with one of said sideframe first and second outer wall surfaces, and said adapter assembly outer end face approximately aligned with the other of said sideframe first and second outer wall surfaces;

said means for securing having an inner plate and an outer plate, each said inner and outer plate generally extending, respectively, from said side frame inner and outer surfaces at least partially over said assembly inner and outer assembly end faces, and means for fastening said inner and outer plates to said sideframe inner and outer surfaces to anchor said inner and outer plates to maintain said adapter assembly in said pedestal-jaw opening.

3. A bearing adapter assembly as claimed in claim 2 wherein each said inner and outer plate generally conforms to said related adapter assembly end face and contacts said respective sideframe first and second outer wall surface.

4. A bearing adapter assembly as claimed in claim 2 wherein said outer plate has a first wall thickness,a second wall thickness thinner than said first wall thickness and a shoulder at the intersection of said first and second wall thickness, said bearing assembly end face nested against said second wall thickness and said bearing outer circumference contacts said shoulder intersection with said adapter assembly end face contacting said first wall thickness.

5. A bearing adapter assembly as claimed in claim 1 wherein said pedestal-jaw opening has a first angular wall segment and a second angular wall segment, said first angular segment extending between said pedestal-jaw opening upper portion and one of said jaw-opening first and second sidewalls, and said second angular segment extending between said upper portion and the other of said first and second sidewalls, each said first and second angular wall segments at approximately equal first angular displacement from said horizontal bearing diameter;

said adapter assembly having a third angular segment and a fourth angular segment, said third angular segment extending between said adapter assembly upper portion and one of said first and second adapter assembly sidewalls, said fourth angular segment extending between said adapter assembly upper portion and the other of said assembly first and second assembly sidewalls, said third and fourth angular segments at approximately said first angular displacement from said horizontal bearing diameter, said securing means including said adapter assembly upper portion, first and second sidewalls, and said third and fourth angular segments matable with said pedestal-jaw opening upper portion, first and second sidewalls, and said first and second angular segments tightly fit said adapter assembly in said pedestal-jaw opening.

6. A bearing adapter assembly as claimed in claim 5 wherein each said pedestal-jaw first angular segment and said second angular segment further includes a projection extending into said pedestal-jaw opening and said adapter assembly third and fourth angular segments each include a channel to receive the juxtaposed projection from the respective one of said pedestal-jaw first and second angular segments, said pedestal-jaw projections and assembly channels matable to secure said adapter assembly in said jaw opening.

7. A bearing adapter assembly as claimed in claim 5 wherein said pedestal-jaw opening upper portion defines an aperture;

means for fastening positioned in said aperture;

said adapter assembly upper portion having a stud projecting from said upper portion, said stud nestable in said aperture and matable with said fastening means to anchor said adapter assembly in said pedestal-jaw opening.

8. A bearing adapter assembly as claimed in claim 1 further comprising an elastomeric insert positioned between said adapter assembly inner surface and said pedestal-jaw surface to inhibit wear between said bearing circumference and said housing.

9. A bearing adapter assembly as claimed in claim 8 wherein said elastomeric insert is about fully compressed and rigidly deformed after mating of said bearing assembly and said adapter assembly.

10. A bearing adapter assembly to rigidly retain a bearing assembly and axle end of an axle in a railway truck sideframe pedestal jaw, each said railway truck having a first longitudinal axis, a first sideframe and a second sideframe, which sideframes are about parallel to each other and to said first longitudinal axis, each said sideframe having a first pedestal jaw, a second pedestal jaw, a first outer wall surface and a second outer wall surface with a wall thickness between said first and second outer wall surfaces, one of said first sideframe first and second pedestal jaws generally aligned with one of said second sideframe first and second pedestal jaws, and the other of said first sideframe first and second pedestal jaws generally aligned with the other of said second sideframe first and second pedestal jaws;

an axle extending between a first sideframe pedestal jaw and a generally aligned second sideframe pedestal jaw at each said pedestal jaw end, each said first and second pedestal jaw having an upper wall, a first sidewall and a second sidewall, said upper wall, first sidewall and second sidewall cooperating to define a pedestal-jaw opening at each said first and second pedestal jaw, which pedestal-jaw opening is an inverted and generally u-shaped trough;

said bearing adapter assembly positionable in said opening, said axle being generally cylindrical and having a second longitudinal axis, a first end and a second end;

a bearing assembly mounted on each said axle first and second axle end, said bearing being generally annular with a horizontal diameter and having a bearing end face with an outer circumference, said bearing horizontal diameter generally extending through said second longitudinal axis and intersecting said outer circumference at a first contact point and a second point, said second longitudinal axis and said horizontal diameter cooperating to define a plane, said adapter assembly comprising:

an upper portion, a first sidewall, a second sidewall, an outer surface and an inner surface, said adapter assembly positioned in said pedestal jaw opening with said adapter assembly outer surface contacting said pedestal-jaw upper wall, first sidewall and second sidewall, and extending between about said sideframe first and second outer wall surfaces;

means for rigidly securing said adapter assembly to said sideframe in said pedestal jaw opening;

said adapter assembly inner surface contoured to receive said bearing outer circumference, which bearing on said axle end is nestable against said contoured inner surface, said securing means having an upper surface, a first arm with an inner surface and a second arm with an inner surface generally extending vertically downward from said securing means upper surface, one of said first and second arm inner surfaces tangentially contacting said bearing circumference at about one of said first and second contact points, and the other of said first and second arm inner surfaces tangentially contacting said bearing circumference at about the other of said first and second circumference contact points to securely grip and retain said bearing assembly and axle end against motion along said first longitudinal axis and against rotational motion in a plane defined by said second longitudinal axis and said horizontal bearing diameter.

11. In a railcar truck assembly having a first longitudinal axis, a first sideframe, a second sideframe, a bolster coupling said first and second sideframes, a first axle and a second axle, said first and second sideframes about parallel and, said bolster, first axle and second axle about normal to said first and second sideframes, each said first and second sideframe having a sideframe longitudinal axis, a forward end, a rearward end, an inner facing surface and an outer facing surface, said sideframe axes generally parallel to said first longitudinal axis, each said first and second axle being generally cylindrical and having an axle longitudinal axis, a first axle end and a second axle end, a plurality of bearing assemblies for said first and second axles, a bearing assembly mounted on each said first and second axle end, each said bearing assembly being generally annular and having an end face, an outer circumference, and a horizontal diameter at said bearing end face intersecting said circumference at a first contact point and a second contact point, said horizontal diameter intersecting and cooperating with said axle longitudinal axis to define a generally horizontal plane, each said first and second sideframe having a first pedestal jaw, a second pedestal jaw, a first outer wall surface and a second outer wall surface with a wall thickness between said first and second outer wall surfaces;

each said first and second pedestal jaws having an upper wall, a first sidewall and a second sidewall, said upper wall, first sidewall and second sidewall having an outer wall surface and cooperating to define a pedestal-jaw opening at each said first and second pedestal jaw, said first and second pedestal-jaw openings at said respective forward and rearward ends of said first and second sideframes being generally aligned at a reference position;

a plurality of bearing adapter assemblies to reduce truck hunting in said truck assembly, each said bearing adapter assembly comprising:

an upper portion, a first sidewall, a second sidewall, an outer surface and an inner surface, said adapter assembly positioned in said pedestal-jaw opening with said adapter assembly outer surfaces contacting said pedestal-jaw wall surfaces, and generally extending between about said sideframe inner and outer wall surfaces;

means for rigidly securing said adapter assembly to said sideframe in said pedestal-jaw opening;

said adapter assembly inner surface contoured to receive said bearing-assembly outer circumference, which bearing on said axle end is nestable against said adapter-assembly contoured inner surface, said adapter assembly first sidewall inner surface tangentially contacting said bearing circumference at about one of said first and second contact points, and said adapter assembly second sidewall inner surface tangentially contacting said bearing circumference at about the other of said first and second contact points to securely grip and retain said bearing and axle end against displacement along said first longitudinal axis and against rotational motion in said horizontal plane to retain said axles is said pedestal-jaw openings and to maintain said first and second axles and sideframes in their respective parallel reference positions to reduce truck hunting.

12. In a railcar truck bearing adapter assembly as claimed in claim 11, wherein said adapter assembly has an outer end and an inner end, said adapter assembly approximately extending between said sideframe inner surface and outer surface with said adapter assembly inner end and outer end approximately aligned with said adapter assembly inner and outer surfaces, said assembly further comprising means for fastening;

said means for securing having an inner plate and an outer plate, each said plate generally extending, respectively, from said sideframe inner and outer surfaces to said inner and outer adapter ends, said fastening means securing said inner and outer plates to said sideframe inner and outer surfaces to anchor said inner and outer plates to maintain said adapter assembly in said pedestal-jaw opening.

13. A bearing adapter assembly as claimed in claim 12 wherein each said inner plate and outer plate generally conforms to said adapter assembly end and contacts said respective sideframe surface.

14. A bearing adapter assembly as claimed in claim 12 wherein each said inner plate and outer plate has a first wall with a first-wall thickness, a second wall with a second-wall thickness thinner than said first wall thickness and a shoulder at the intersection of said first and second wall thickness, said bearing assembly end face nested against said second wall thickness with said end face circumference contacting said shoulder intersection and said adapter assembly end-face contacting said first wall thickness.

15. A bearing adapter assembly as claimed in claim 11 wherein said pedestal jaw opening further includes a first angular segment and a second angular segment, said first angular segment extending between said pedestal-jaw opening upper wall and one of said pedestal-jaw opening first and second sidewalls, and said second angular segment extending between said upper wall and the other of said first and second pedestal-jaw sidewalls, each said first and second angular segment at approximately the same and directionally opposite first angular displacement from the horizontal bearing diameter;

said adapter assembly having a third angular segment and a fourth angular segment, said third angular segment extending between said adapter assembly upper portion and one of said first and second adapter assembly sidewalls, said fourth angular segment extending between said adapter assembly upper portion and the other of said first and second adapter assembly sidewalls, said third and fourth angular segments at approximately said first angular displacement from said horizontal bearing diameter.

said securing means having said adapter assembly upper portion, first and second sidewalls, and said third and fourth tapered segments matable with said pedestal-jaw opening upper wall, first and second sidewalls, and said first and second angular segments to tightly fit said adapter assembly in said pedestal-jaw opening.

16. In a railcar truck bearing adapter assembly as claimed in claim 15 wherein said first angular segment and said second angular segment each further include a projection extending into said pedestal-jaw opening and said third and fourth angular segments each include a channel to receive the juxtaposed projection from the respective one of said first and second angular segments, said projections and channels matable to secure said adapter assembly in said pedestal-jaw opening.

17. In a railcar truck bearing adapter assembly as claimed in claim 15 wherein said pedestal-jaw opening upper wall defines an aperture, said bearing adapter assembly further to including, means for fastening positioned in said aperture;

said adapter assembly upper portion having a stud projecting from said upper portion and nestable in said upper-wall aperture, said fastening means matable with said stud to anchor said adapter assembly in said pedestal-jaw opening.

18. A bearing adapter assembly as claimed in claim 11 further comprising an elastomeric insert positioned in said adapter assembly inner surface to inhibit wear between said bearing circumference and said inner surface.

19. A bearing adapter assembly as claimed in claim 18 wherein said elastomeric insert is approximately fully compressed and rigidly deformed at mating of said bearing assembly and said adapter assembly.

20. A bearing adapter assembly to rigidly retain a bearing and axle end of an axle in a railway truck sideframe pedestal jaw, each said sideframe having a first longitudinal axis, a first pedestal jaw, a second pedestal jaw, a first outer wall surface and a second outer wall surface with a wall thickness between said first and second outer wall surfaces, each said first and second pedestal jaw having an upper wall, a first sidewall and a second sidewall, said upper wall, first sidewall and second sidewall cooperating to define a pedestal jaw opening at each said first and second pedestal jaw, a plurality of said bearing adapter assemblies, one of said bearing adapter assemblies positionable in said opening, said axle being generally cylindrical with a second longitudinal axis, a first end and a second end, a plurality of bearing assemblies, one of said bearing assemblies mounted on each said axle first and second end, said bearing assembly being generally annular with a horizontal diameter, an end face and an outer circumference, said horizontal diameter generally extending through said second longitudinal axis and intersecting said outer circumference at a first contact point and a second contact point, said second longitudinal axis and said horizontal diameter cooperating to define a generally horizontal plane, said adapter assembly comprising:

an upper portion, a first sidewall, a second sidewall, an outer surface and an inner surface, said adapter assembly positioned in said pedestal-jaw opening with said adapter assembly outer surfaces contacting said pedestal-jaw upper wall, first sidewall and second sidewall, and extending between about said sideframe first and second outer wall surfaces;

said adapter assembly inner surface contoured to receive said bearing outer circumference, said bearing assembly and axle end nestable against said contoured inner surface, means for rigidly securing said adapter assembly to said sideframe in said pedestal-jaw opening, said securing means integral with said adapter assembly and having an upper surface, a first arm with an inner surface and a second arm with an inner surface, said first arm and second arm generally extending vertically downward from said securing means upper surface, one of said first and second arm inner surfaces tangentially contacting said bearing circumference at about one of said first and second contact points, and the other of said first and second arm inner surfaces tangentially contacting said bearing circumference at about the other of said first and second contact points to securely grip and retain said bearing and axle end against motion along said longitudinal axis and against rotational motion in said horizontal plane defined by said axle longitudinal axis and said horizontal bearing diameter.

* * * * *